United States Patent [19]

Gollinger et al.

[11] Patent Number: 4,646,639

[45] Date of Patent: Mar. 3, 1987

[54] APPARATUS FOR STRETCHING A PRINTING PLATE ON A PLATE HOLDING CYLINDER

[75] Inventors: Franz X. Gollinger, Hirschbach; Hatto Hechler, Augsburg, both of Fed. Rep. of Germany

[73] Assignee: MAN-ROLAND Druckmaschinen Aktiengesellschaft, Augsburg, Fed. Rep. of Germany

[21] Appl. No.: 803,136

[22] Filed: Nov. 29, 1985

[30] Foreign Application Priority Data

Nov. 28, 1984 [DE] Fed. Rep. of Germany ..... 3443353

[51] Int. Cl.[4] ..... B41F 27/06; B41F 27/12

[52] U.S. Cl. ..... 101/415.1

[58] Field of Search ..... 101/415.1, 378, DIG. 12, 101/382 R, 383

[56] References Cited

U.S. PATENT DOCUMENTS

| | | | |
|---|---|---|---|
| 3,230,883 | 1/1966 | Achinger et al. | 101/415.1 |
| 3,335,663 | 8/1967 | Harenza | 101/415.1 |
| 3,359,899 | 12/1967 | Cuehrs | 101/415.1 |

*Primary Examiner*—J. Reed Fisher

*Attorney, Agent, or Firm*—Frishauf, Holtz, Goodman & Woodward

[57] ABSTRACT

To simply and reliably connect together clamping jaws located in the groove of a printing machine cylinder, while permitting secure and aligned positioning of jaw pairs holding the leading edge of a printing plate while permitting self-alignment or self-adjustment by pivoting movement of jaw pairs holding the trailing end, a bolt with an intermediate flange is screwed into the side wall of the groove, the jaw which is to positively position the leading end of the plate is engaged against the flange and located by a nut threaded on the bolt, the bolt previously having been adjusted to set the circumferential register of the plate by screwing into—and out—from the cylinder wall. The associated jaw of the pair clamps the plate in position. At the trailing end, the nut is not used or loosened, for example held against removal by a C-ring, so that springs which clamp both jaws together can also move that one of the jaws closest to the side wall towards the inside of the groove, thus tensioning the trailing end of the plate.

8 Claims, 2 Drawing Figures

APPARATUS FOR STRETCHING A PRINTING PLATE ON A PLATE HOLDING CYLINDER

Reference to related publication

Swedish Patent Publication No. 324,790, laid opon for public access July 1, 1968, Harenza, to which U.S. Pat. No. 3,335,663 and German No. 1,561,007 correspond.

The present invention relates to printing machinery, and more particularly to an arrangement to clamp printing plates on plate cylinders, and especially to clamp flexo or offset plates on respective flexo or offset plate cylinders.

BACKGROUND

Printing plates are usually clamped on plate holding cylinders by forming an axially extending groove in the plate holding cylinders and locating clamping tongs or clamping jaws in the groove. The clamping jaws can be positively tightened against each other to clamp the plate in the groove, or they can be resiliently spring-pressed against each other. Usually, the leading edge of the plate—with respect to the direction of rotation of the cylinder—is so arranged that the jaws clamp the respective end of the plate fixedly, so that circumferential register can be controlled; the trailing end of the plate, then, is clamped by resilient clamping jaws.

Swedish Publication No. 324,790, Harenza, to which U.S. Pat. No. 3,335,663 and German No. 1,561,007 correspond, describes an arrangement in which, in dependence on the direction of rotation of the cylinder, the clamping jaw holding the leading edge of the plate is fixed in position by a blocking mechanism; the clamping jaw holding the trailing end of the plate is spring-biassed, in order to provide tension on the plate at the trailing end. The arrangement is so made that it is mirror-symmetrical, so that the direction of rotation of the plate cylinder can be freely selected. Depending on the direction of rotation, the jaws are, selectively, either fixedly clamped or spring-loaded against each other, in dependence on which one of the jaws receives the leading and the trailing ends, respectively.

The arrangement as described is complex and additional apparatus must be used in order to permit circumferential register adjustment of the plate. The trailing end of the plate should not be fixedly clamped since plates used in offset and flexo printing frequently have a resilient or soft underlay or are, inherently, furnished with such a material which should be capable of escaping upon application of printing pressure at the printing line, and to prevent formation of a bulge during rolling contact of the plate cylinders against an opposing cylinder.

THE INVENTION

It is an object to provide a clamping arrangement which is capable of selectively clamping printing plates, particularly for offset and flexo printing processes and which is simple, while permitting to securely position that one of the ends of the plates which becomes a leading edge and additionally permits adjustment of the circumferential register, preferably with the same elements used to clamp the plate, while permitting, selectively, use of the very same clamping elements under spring pressure only if the direction of rotation of the cylinder is changed so that the clamping jaws previously clamping the leading edge then will clamp the trailing edge of the plate.

Briefly, clamping arrangements are located in each one of opposed side walls of the groove in the cylinder, the arrangements being mirror-symmetrical. For ease of explanation, only one of the arrangements will be here described. A threaded bolt is positioned by being threaded into a matching threaded bore of the side wall of the groove. The threaded bolt and one of the jaws are formed with interengaging projection-and-recess means so that the engaged jaw can be positioned more or less against the side wall, in dependence on how much the bolt is threaded into its bore in the side wall. This, simply, permits adjustment of the circumferential register of the plate, the jaw being movably retained in the groove of the cylinder. The other one of the jaws, against which the plate is clamped, is selectively positionable against the first jaw, by selectively locking the other jaw against the first one or permitting it to be pressed against the first one by spring pressure. In accordance with a feature of the invention, and for simply overriding the spring pressure and providing for positive clamping force, the bolt has a thread beyond the projection-and-recess means, most simply formed by a flange engaging into a groove of the first jaw, and the associated jaw is merely clamped against the first one by a nut threaded on the threaded extension of the bolt. If the direction of rotation of the cylinders is reversed, the nut can be loosened and, instead, spring pressure is then applied against the second jaw.

DRAWINGS

FIG. 1 is a perspective illustration of a printing plate holding cylinder, illustrating the region of the clamping groove thereof and showing, in fragmentary cut and section portions, the basic arrangement; and FIG. 2 is a fragmentary radial section through a holding cylinder in the region of the clamping groove, in which section lines are taken in different axial planes on the right and left side of the groove for ease of illustration.

DETAILED DESCRIPTION

Figure 1:
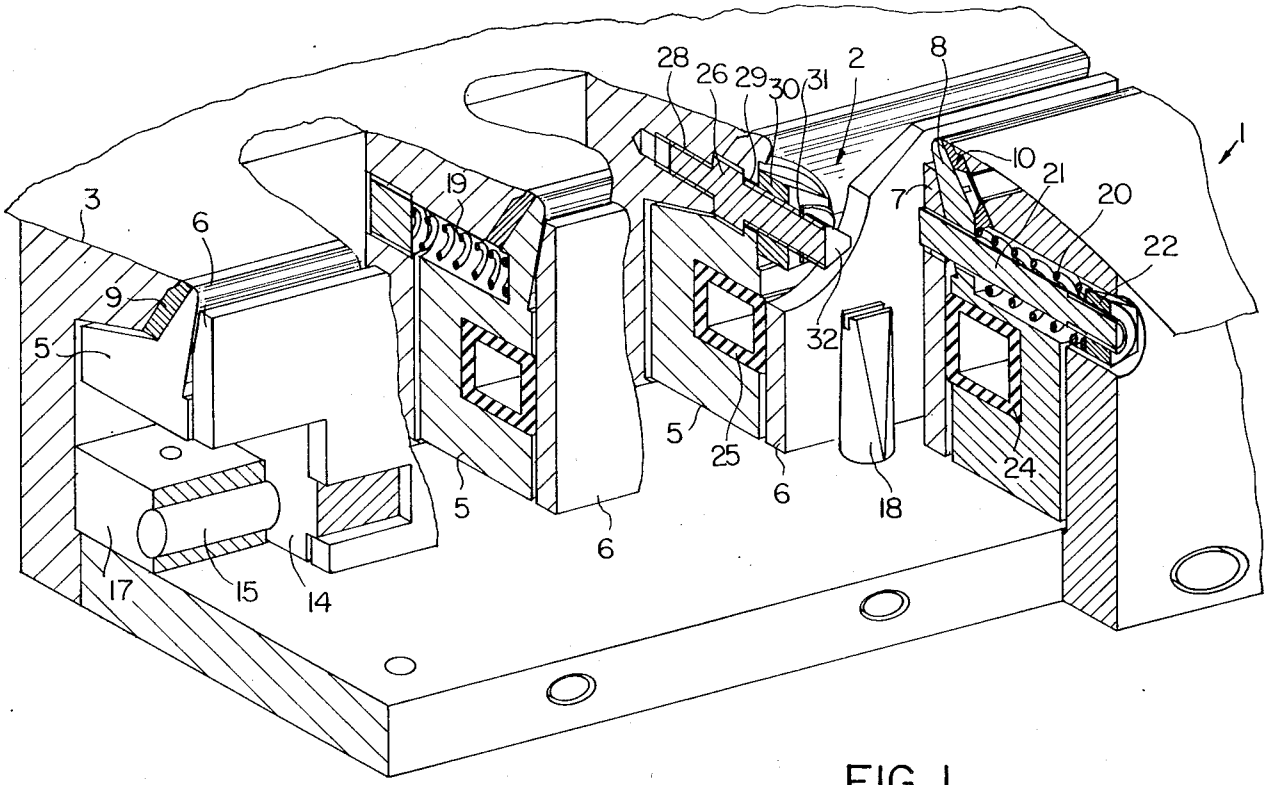

The clamping arrangement is provided in duplicate, symmetrical, but axially offset location. The plate cylinder 1—shown only in fractional representation—can be used in rotary printing machines operating in an offset printing mode as well as rotary printing machines suitable for flexo printing. If the plate cylinder 1 is used in a flexo printing machine, it is necessary that the printing plate 3, to be secured with its ends in the axial cylinder groove or slot 2, is located over a sufficiently thick elastic underlay or padding 4. Upon engagement of the printing plate, with the padding 4 therebeneath, the diameter of the printing cylinder at the surface of the plate 1 will change due to the pressure of an associated printing cylinder—not shown—which requires retaining the trailing end of the printing plate in the groove or slot 2 in a resilient manner. Depending on the direction of rotation of the cylinder 1, the clamping jaw pairs 5, 6 or 7, 8—see FIG. 1—must be maintained in resilient relationship, from point of view of circumferential direction; the other clamping jaw pair must be securely and reliably positioned with respect to a circumferential reference, excluding any spring pressure acting thereagainst. The other pair, thus, must be blocked. The initial position of printing which controls register must be definitely controllably adjustably set. Thus, one of the clamping jaw pairs 5, 6 or 7, 8 must be securely fixed in position, whereas the other should be retained resiliently within the groove.

Figure 2:
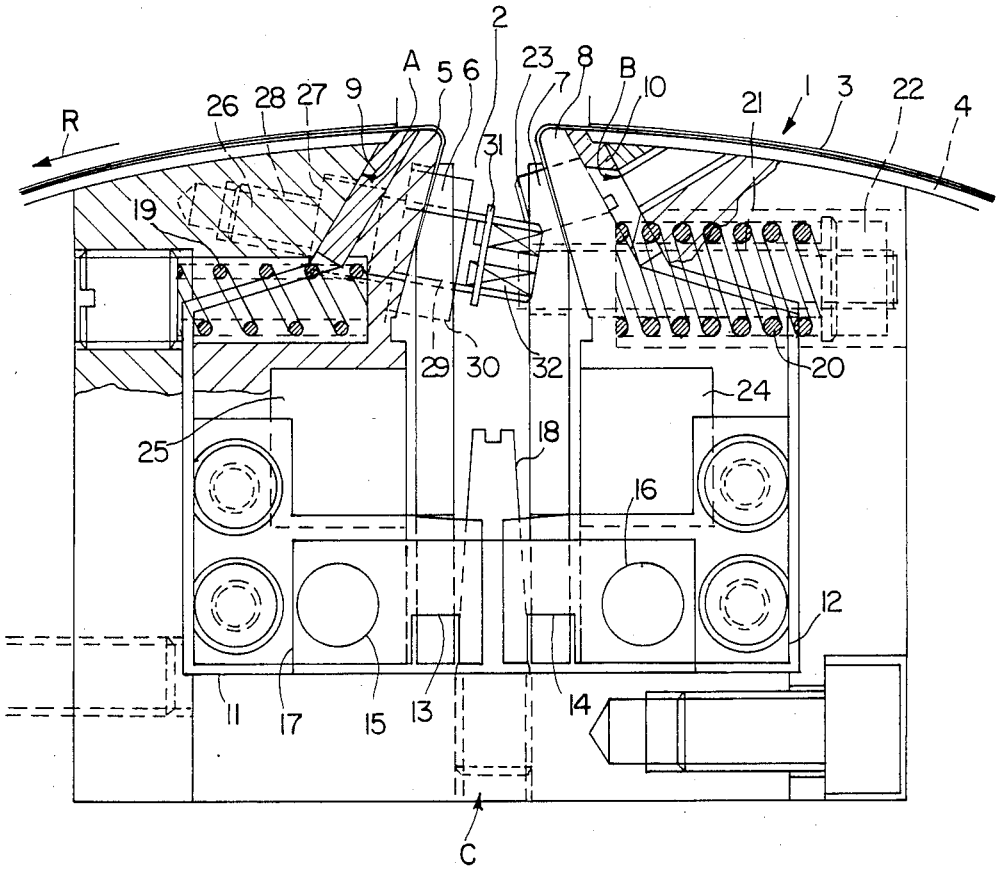

The direction of rotation of the cylinder 1 in FIG. 2 is shown by the arrow R, that is, in counterclockwise direction when looking at the drawing. The clamping jaws 7, 8, thus, clamp the leading edge of the printing plate, and must be blocked in position in the groove; the clamping jaw pair formed by the jaws 5, 6 must be resiliently retained in the groove.

The outer clamping jaws 5, 8—with respect to the groove 2—engage a strip 9, 10, respectively, which is secured, in turn, on one of the side walls A, B of the groove or slot 2. The clamping jaw pairs 5, 6 and 7, 8 are formed with lower portions which are engaged by blocks 11, 12 about which they can tilt or tip. The blocks 11, 12 are formed with recesses 13, 14 on which the inner jaws 6, 7 are retained for tipping or rocking or tilting movement; the outer clamping jaws 5, 8 are located on a bolt 15, 16.

The blocks 11, 12 are secured to a bottom plate 17 which is screw-retained on the bottom wall C of the groove or slot 2. The arrangement permits rocking or shifting the jaws 5, 6 together in circumferential direction while additionally permitting relative movement of the jaws 5, 6 of the pair against each other. The arrangement for the jaw pair 7, 8 is similar and, likewise, the jaws of the pair 7, 8 can move together as well as relative to each other, independently of the common movement. The inner jaws 6, 7—with respect to a center line through the groove—are limited in their tipping movement by a fixed stop 18 secured to the base C of the groove or slot 2.

The jaws 5, 6 and 7, 8, respectively, are pressed together by respective springs 19, 20 after the end of the printing plate 3 has been inserted therebetween. As clearly seen in FIG. 1, spring 20 is located on a bolt 21, which passes through both of the jaws 7, 8. The force of the spiral springs 19, 20 can be controlled by tightening or loosening, respectively, a nut 22 threaded on the bolt 20. The holding force of the clamping jaws 7, 8 thus can be readily controlled to have a desired value. Register pins 23—see FIG. 2—are used as well known, and are located in standard manner.

To insert or remove a printing plate 3, it is necessary to separate the jaws 5, 6 and 7, 8, respectively, from each other. Air hoses 24, 25 are preferably used to spread the jaws of the pairs apart. The air hoses are coupled to valves located at the facing sides of the plate cylinder—not shown—to which compressed air can be supplied. By introducing compressed air into the hoses 24, 25, thus expanding the hoses, the inner jaws 6, 7 are spread in the direction of the stop 18 counter the action of the spring 20. Opening of the jaws will be explained in greater detail below. Springs 19, 20 tend to press both jaws 5, 6 and 7, 8 of the pairs toward the center line of the groove 2.

In accordance with the present invention, and to adjust the respective position of the leading clamping jaw pair (in FIG. 2, these are the jaws 7, 8), a simple bolt 26, which is formed with an intermediate flange 27 and threaded at both ends opposite the flange 27, is used. The bolt 26—see FIG. 2—is threaded with the left end 28 into the cylinder. The right end 29 has a nut 30 located thereon—see also FIG. 1. The right end 29 passes through the upper region of the clamping jaws 5, 6 such that the flange 27 engages the outer jaw 5 at the outer side thereof; the nut 30 may engage the inner jaw 6. These elements are used for the jaw pairs 5, 6 as well as 7, 8. Alternatively, and in FIG. 2, the bolt 26 is seen in engagement with the jaw 5 to clamp jaw 5 between the flange 27 and the nut 30, spring 19 pressing jaws 5 and 6 together. In FIG. 1, the jaw 6 is cut away to clearly show the nut 30 engaging jaw 5.

Upon rotation of the cylinder in counterclockwise direction—see arrow R—the clamping jaws 7, 8 should be secured with respect to the circumference of the printing plate in a predetermined location. This permits circumferential register to be accurately controlled with respect to the one end of the plate. For such control, bolt 26 is screwed into the cylinder 1 for a suitable distance until the desired circumferential position of the jaw 8, engaged by the flange 27, is appropriate to locate the plate, held on the register pins 23, in the proper position. Thereafter, nut 30 is tightened so that the leading plate end, clamped between the jaws 7, 8, is fixed. To adjust the position of the double-threaded bolt 26, the end thereof extending into the groove 2 can be formed with a socket receiving end, for example can be squared off to receive a wrench, socket, or the like. A C-ring 31 can, additionally, be located thereon.

In accordance with a feature of the invention, the change in diameter of the plate at the trailing ene can be compensated by the spring 19 which engages with the end opposite the adjustment nut 22 against the outer one of the clamping jaws 5, thus providing a bias force thereagainst in clockwise direction. Upon loosening of the nut 30, the inner clamping jaw 6, and hence the entire jaw pair, is released. The force of the spring 19 will force the jaw 5 against the jaw 6 which, upon rotation in counterclockwise direction, will continue to clamp the trailing end, by rocking or tilting the jaws 5 and 6 in clockwise direction, thereby stretching the plate.

Upon reversal of the direction of rotation, that is, upon rotation of the cylinder 1 in the direction counter the arrow R, the jaws 5, 6 will be adjusted as previously described in connection with the jaws 7, 8 in order to set in similar manner the register at the beginning of the printing on the plate; and, as described in connection with the jaws, 5, 6, the jaw pair 7, 8 is then released to permit the spring 20 to press the jaws against each other in order to clamp what then will be the trailing end of the plate and permit rocking of the jaw pair 7, 8 about its bottom support at the bottom of the groove 2.

To release the plates, for example upon exchange of printing plates, and to receive a new plate, the compressed air hoses 24, 25 are subjected to compressed air. After release of the nuts 30, the inner jaws 6, 7 will tip or rock inwardly towards the stop 18. When they are engaged by the stop 18, the outer jaws 5, 8 will be pressed outwardly, against the force of the spring 19, 20 so that the jaw pairs 5, 6, 7, 8 will open, that is, spread apart in the direction of the walls A, B of the groove. The nut 30 can also be so arranged that it engages against the outer jaw 5 only—see FIG. 1—to fix the position of the outer jaw. For removal, the outer jaw will then retain its position as determined by the extent of the threading of the bolt 26 into the threaded bore in the side wall of the cylinder, the flange 27 and the nut 30. The force of the spring 19 is thus excluded from acting on the so-fixed jaw 5 and pressurization of the respective hose 25 will then immediately spread apart the outer jaw 6 to provide rapid opening of the jaw pair 5, 6.

We claim:

1. Apparatus for resiliently stretching a printing plate (3, 4) on a plate holding cylinder (1) in which a compressible medium (4) is interposed between the printing surface of the printing plate and the plate holding cylinder (1), particularly for offset or flexo printing plates, said plate holding cylinder (1) being formed with an axially extending clamping groove (2) and having cooperating first, second, third and fourth clamping jaws associated in clamping jaws pairs (8, 7; 5, 6) located at respective opposite inner walls (A, B) of the groove (2);

spring means (19, 20) positioned to exert a biassing force against the clamping jaws tending to press the jaws together and comprising means for locking a first one of the pairs of jaws (8, 7) together which clamps the leading end of the plate, with respect to the direction of rotation of the cylinder, for positively controlling circumferential register while leaving a second one of the pairs of jaws (5, 6) under spring compression which clamps the trailing end of the printing plate to permit self-alignment and elimination of a terminal welt, including a threaded bolt (26, 28, 29), each, threadedly positioned in each of the side walls (A, B) of the groove (2);

interengaging abutment means formed on one of the jaws of the first pair and on the bolt, respectively, to adjust the position of the first jaw (8) clamping the leading end of the plate with respect to an adjacent side wall (B), and hence permit adjustment of the circumferential register of the plate;

and means (30) for selectively locking said first jaw (8) to the bolt to provide for locking of the threading end of the plate between the first jaw (8) and the second jaw (7) associated with said first jaw (8), while permitting unlocking of the third jaw (5) positioned at the opposite wall (A) for resiliently maintaining said unlocked third jaw (5) and the fourth jaw (6) associated with the third jaw (5) under spring pressure by said spring means (19, 20) to resiliently bias said unlocked third jaw (5) and associated jaw (7) to hold the trailing end of the plate in stretched position within the groove.

2. Apparatus according to claim 1, including means (13–17) for movably retaining the pairs of jaws within the groove.

3. Apparatus according to claim 1, wherein the locking means comprises a nut for selectively locking the jaw engaged by the abutment means to said bolt.

4. Apparatus according to claim 1, wherein the spring means comprises a spiral spring (19, 20) positioned to compress the jaws of the pairs (5, 6; 7, 8) together;

and wherein a spring guide bolt (21) is provided secured in the respective side wall (A, B) of the groove, fitted within the spiral spring.

5. Apparatus according to claim 1, further including means to separate the jaws of the pairs from each other counter the force of the spring means (19, 20) comprising compressed air separating hoses located between the jaws (5, 6; 7,8) of the respective pairs, said compressed air hoses expanding upon being pressurized and separating the jaws of the pairs from each other.

6. Apparatus according to claim 1, wherein the threaded bolt (26) is formed with a tool engaging end (32) at an end portion thereof projecting into the groove (2).

7. Apparatus according to claim 5, further including a fixed stop (18) located between inner jaws (6, 7), with respect to a center line through the groove (2), of the pairs of jaws (5, 6; 7, 8);

and wherein the compressed air hose is located between the jaws of the pairs to provide for movement of the inner jaws towards the fixed stop (18) upon pressurization of the compressed air hose (24, 25) with compressed air and overcoming the spring bias force of the spring means tending to compress the jaws (5, 6; 7, 8) of the pairs together, the outer jaws (5, 8), with respect to the center line of the groove, of the pairs (5, 6; 7, 8) of the jaws, after overcoming of the bias force by the spring means bearing against the respective walls (A, B) of the groove or, selectively, against an abutment (27) of said threaded bolt.

8. Apparatus according to claim 1, further comprising pivoting or tilting holding means (13–17) securing ends of the jaws of the pairs (5, 6; 7, 8) adjacent the root or bottom (C) of the groove;

and a holding block (11) secured in the root or bottom of the groove to retain said pivotable holding means in position in the groove.

* * * * *